US011063381B2

(12) United States Patent
Urano et al.

(10) Patent No.: US 11,063,381 B2
(45) Date of Patent: Jul. 13, 2021

(54) ELECTRIC CONNECTOR

(71) Applicant: Japan Aviation Electronics Industry, Limited, Tokyo (JP)

(72) Inventors: Tetsu Urano, Tokyo (JP); Takaaki Kudo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/897,007

(22) Filed: Jun. 9, 2020

(65) Prior Publication Data

US 2020/0303857 A1 Sep. 24, 2020

Related U.S. Application Data

(63) Continuation of application No. PCT/JP2018/034665, filed on Sep. 19, 2018.

(30) Foreign Application Priority Data

Mar. 8, 2018 (JP) ..... JP2018-041772

(51) Int. Cl.
*H01R 13/64* (2006.01)
*H01R 13/24* (2006.01)

(52) U.S. Cl.
CPC ..... *H01R 13/2457* (2013.01); *H01R 13/2492* (2013.01)

(58) Field of Classification Search
CPC ..... H01R 13/6315; H01R 12/585; H01R 12/7082; H01R 1/42
USPC ..... 439/248, 247
See application file for complete search history.

(56) References Cited

U.S. PATENT DOCUMENTS

| | | | | |
|---|---|---|---|---|
| 2016/0276760 | A1* | 9/2016 | Luo | H01R 12/7088 |
| 2020/0067234 | A1* | 2/2020 | Schneider | H01R 13/10 |
| 2020/0274294 | A1* | 8/2020 | Lynch | H01R 12/58 |
| 2021/0036610 | A1* | 2/2021 | Palm | H01F 17/0033 |

FOREIGN PATENT DOCUMENTS

| | | | |
|---|---|---|---|
| JP | H04253174 | A | 9/1992 |
| JP | H09199240 | A | 7/1997 |
| JP | 2003-037919 | A | 2/2003 |
| JP | 2011-060499 | A | 3/2011 |
| JP | 2012-195299 | A | 10/2012 |

OTHER PUBLICATIONS

Japanese Office Action issued in counterpart application 2018-041772, dated Dec. 25, 2018, 4 pages.

* cited by examiner

*Primary Examiner* — Phuong Chi Thi Nguyen
(74) *Attorney, Agent, or Firm* — Muncy, Geissler, Olds & Lowe, P.C.

(57) ABSTRACT

An electric connector includes a fixing-side contact having a vertical portion of plate shape, a relay contact having a pair of front arms and a pair of rear arms, and an insulator having a relay contact insertion groove, the vertical portion of the fixing-side contact being sandwiched between the pair of rear arms so that the relay contact is held to be swingable with respect to the fixing-side contact and is electrically connected to the fixing-side contact, an opening width of an opening of the relay contact insertion groove of the insulator being shorter than an opening width at ends of the pair of front arms located on a forward side in a fitting direction.

9 Claims, 8 Drawing Sheets

ELECTRIC CONNECTOR

CROSS REFERENCE TO RELATED APPLICATIONS

This application is a Bypass Continuation of co-pending Application No. PCT/JP2018/034665, filed on Sep. 19, 2018, for which priority is claimed under 35 U.S.C. § 120; and this application claims priority of Application No. 2018-041772 filed in JAPAN on Mar. 8, 2018 under 35 U.S.C. § 119; the entire contents of all of which are hereby incorporated by reference.

BACKGROUND OF THE INVENTION

The present invention relates to an electric connector and more specifically relates to an electric connector to be fitted with a counter connector while absorbing positional displacement with respect to the counter connector.

As a connector capable of absorbing positional displacement with respect to a counter connector, for instance, JP 2012-195299 A discloses a connector 1 as illustrated in FIG. 14. The connector 1 includes a fixing-side housing 3 in which a plurality of fixing-side contacts 2 are fixed and a movable-side housing 5 in which a plurality of movable-side contacts 4 are held. The movable-side housing 5 is incorporated in the fixing-side housing 3 to be slidable in a direction perpendicular to a fitting direction with a counter connector 6, and a connection portion 7 for each of the respective movable-side contacts 4 is sandwiched between the fixing-side housing 3 and the movable-side housing 5 so that the movable-side contact 4 is held rotatably around a rotation axis perpendicular to both the fitting direction and the sliding direction of the movable-side housing 5.

As illustrated in FIG. 15, when the counter connector 6 is fitted with the connector 1 in a state in which the plurality of fixing-side contacts 2 fixed in the fixing-side housing 3 and a plurality of contacts 8 of the counter connector 6 are positionally displaced, the movable-side housing 5 slides with respect to the fixing-side housing 3, and the plurality of movable-side contacts 4 are thus rotated. As a result, the positional displacement is absorbed, and the fixing-side contacts 2 of the connector 1 are electrically connected to the contacts 8 of the counter connector 6 via the movable-side contacts 4.

SUMMARY OF THE INVENTION

However, to absorb the positional displacement between the fixing-side contacts 2 and the contacts 8 of the counter connector 6, two housings including the fixing-side housing 3 and the movable-side housing 5 that can slide with respect to each other are required, which causes a problem in which the number of parts and the number of steps for assembling the connector 1 are large, whereby the manufacturing cost is increased, and size reduction of the connector is difficult.

If the movable-side housing 5 is omitted, and only the fixing-side housing 3 is used in order to reduce the number of parts and the number of assembling steps, the orientations of the plurality of movable-side contacts 4 are not uniform so that, with even one movable-side contact 4 being displaced significantly, fitting of the connector 1 with the counter connector 6 cannot be achieved.

The present invention has been made to solve the conventional problem, and an object thereof is to provide an electric connector capable of being fitted with a counter connector while absorbing positional displacement with respect to the counter connector as well as reducing the manufacturing cost and miniaturizing the connector.

An electric connector according to the present invention is an electric connector to be fitted with a counter connector along a fitting direction and electrically connected to the counter connector, the electric connector comprising:

a fixing-side contact including a vertical portion of plate shape extending in the fitting direction;

a relay contact including a pair of front arms extending forward in the fitting direction and opposed to each other in an intersection direction intersecting with the vertical portion of the fixing-side contact and a pair of rear arms extending rearward in the fitting direction and opposed to each other in the intersection direction, the vertical portion of the fixing-side contact being sandwiched between the pair of rear arms so that the relay contact is held to be swingable with respect to the fixing-side contact and is electrically connected to the fixing-side contact; and an insulator including a relay contact insertion groove that has an opening opened forward in the fitting direction, wherein the fixing-side contact is fixed to the insulator, wherein the relay contact is housed in the relay contact insertion groove of the insulator, wherein, in the intersection direction, an opening width of the opening of the relay contact insertion groove of the insulator is shorter than an opening width at ends of the pair of front arms located on a forward side in the fitting direction, and, even when the relay contact swings, the ends of the pair of front arms of the relay contact do not project into the opening of the relay contact insertion groove as viewed from the forward side in the fitting direction, and wherein, when fitting with the counter connector, a contact of the counter connector is sandwiched between the pair of front arms of the relay contact, whereby the electric connector is electrically connected to the counter connector.

DETAILED DESCRIPTION OF THE INVENTION

Hereinbelow, an embodiment of the present invention will be described with reference to the accompanying drawings.

Figure 1:
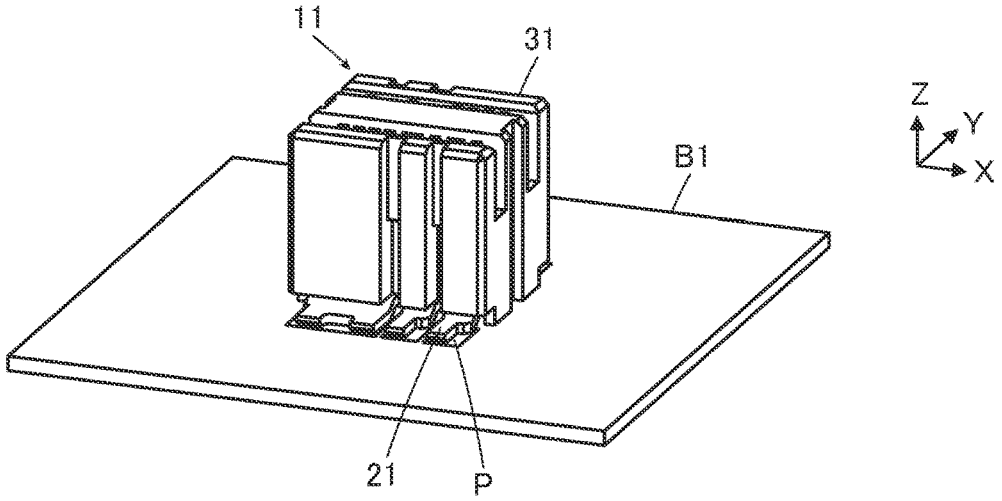
FIG. 1 is a perspective view illustrating an electric connector according to an embodiment of the present invention mounted on a first board.

FIG. 1 illustrates an electric connector 11 according to an embodiment of the present invention. The electric connector 11 includes a plurality of fixing-side contacts 21 and an insulator 31 in which the plurality of fixing-side contacts 21 are fixed, and the plurality of fixing-side contacts 21 are soldered to connection pads P of a first board B1, whereby the electric connector 11 is mounted on the first board B1.

Figure 2:
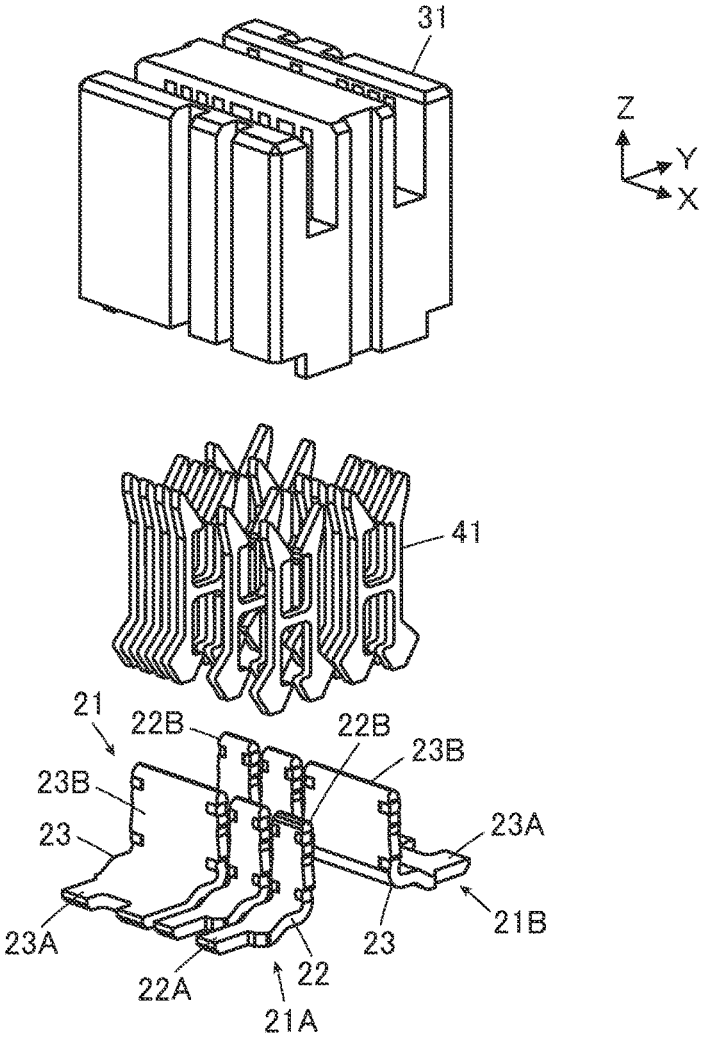
FIG. 2 is an exploded perspective view of the electric connector according to the embodiment.

As illustrated in FIG. 2, the electric connector 11 includes a plurality of relay contacts 41 connected to the plurality of fixing-side contacts 21 and housed inside the insulator 31.

The fixing-side contacts 21 include two contact groups 21A and 21B arranged to be opposed to each other, and each of the contact groups 21A and 21B includes two signal contacts 22 and one power supply contact 23 arranged in line. Each of the signal contacts 22 includes a mounted portion 22A soldered to the connection pad P of the first board B1 and a plate-shaped vertical portion 22B extending vertically to the mounted portion 22A. Each of the power supply contacts 23 is formed to be wider than the signal contact 22 and, similarly to the signal contact 22, includes a mounted portion 23A soldered to the connection pad P of the first board B1 and a plate-shaped vertical portion 23B extending vertically to the mounted portion 23A. The vertical portion 22B of the signal contact 22 of the contact group 21A is opposed to the vertical portion 23B of the power supply contact 23 of the contact group 21B, and the vertical portion 22B of the signal contact 22 of the contact group 21B is opposed to the vertical portion 23B of the power supply contact 23 of the contact group 21A.

The plurality of relay contacts 41 are formed in equal shapes to each other, one relay contact 41 is arranged to correspond to one signal contact 22 of the fixing-side contacts 21, and four relay contacts 41 are arranged to correspond to one power supply contact 23 of the fixing-side contacts 21. Each of the relay contacts 41 is made of a flat metal plate punched in an H shape and is arranged to extend in a direction perpendicular to the vertical portion 22B of the corresponding signal contact 22 or the vertical portion 23B of the corresponding power supply contact 23.

The insulator 31 has a substantially cuboid appearance, and the plurality of relay contacts 41 are swingably housed inside the insulator 31.

Here, for convenience, a plane on which the vertical portion 22B of the signal contact 22 and the vertical portion 23B of the power supply contact 23 in the fixing-side contacts 21 extend is referred to as an XZ plane, a plane on which the respective relay contacts 41 extend is referred to as a YZ plane, and a direction vertical to a surface of the first board B1 on which the mounted portion 22A of the signal contact 22 and the mounted portion 23A of the power supply contact 23 in the fixing-side contacts 21 are mounted and from the surface of the first board B1 toward a side on which the electric connector 11 is arranged is referred to as a +Z direction. The +Z direction is a fitting direction of the electric connector 11 with a counter connector described below.

Figure 3:
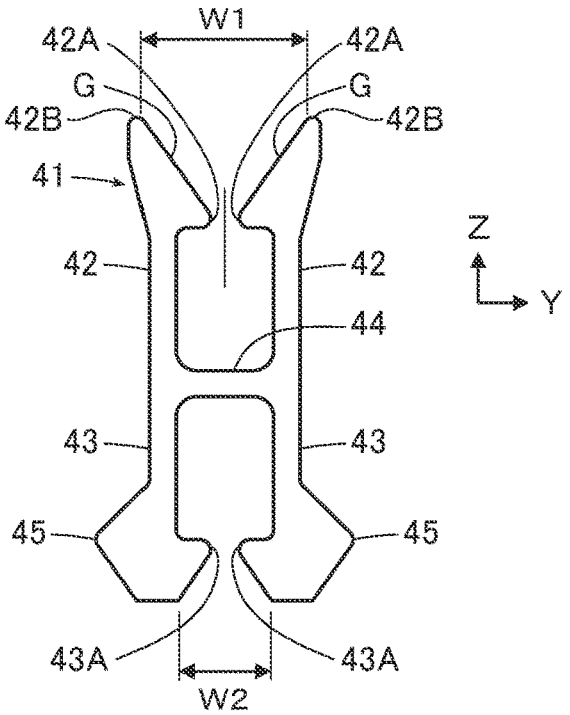
FIG. 3 is a front view illustrating a relay contact used in the electric connector according to the embodiment.

As illustrated in FIG. 3, the relay contact 41 includes a pair of front arms 42 extending forward in the fitting direction, that is, in the +Z direction, and a pair of rear arms 43 extending backward in the fitting direction, that is, in a −Z direction, and opposed to each other in the Y direction. The pair of front arms 42 as well as the pair of rear arms 43 are opposed to each other in the Y direction, which is an intersection direction vertically intersecting with the vertical portion 22B of the signal contact 22 or the vertical portion 23B of the power supply contact 23. The relay contact 41 also includes a connection portion 44 arranged between the pair of front arms 42 and the pair of rear arms 43 and extending in the Y direction and is formed in an H shape as a whole.

The pair of front arms 42 are provided with a pair of contact portions 42A opposed to each other in the Y direction for contacting a contact of the counter connector described below, and the pair of rear arms 43 are provided with a pair of contact portions 43A opposed to each other in the Y direction for contacting the vertical portion 22B of the signal contact 22 or the vertical portion 23B of the power supply contact 23 in the fixing-side contact 21.

Also, an opening width W1 at +Z-direction ends 42B of the pair of front arms 42 is set to be longer than an opening width W2 at −Z-direction ends of the pair of rear arms 43, an opening width at the pair of contact portions 42A is shorter than the opening width W1 at the +Z-direction ends 42B, and a guide surface G inclined with respect to a Z direction is formed from the +Z-direction end 42B to the contact portion 42A.

Further, each of the pair of rear arms 43 is provided with a projection portion 45 projecting in the Y direction.

Figure 4:
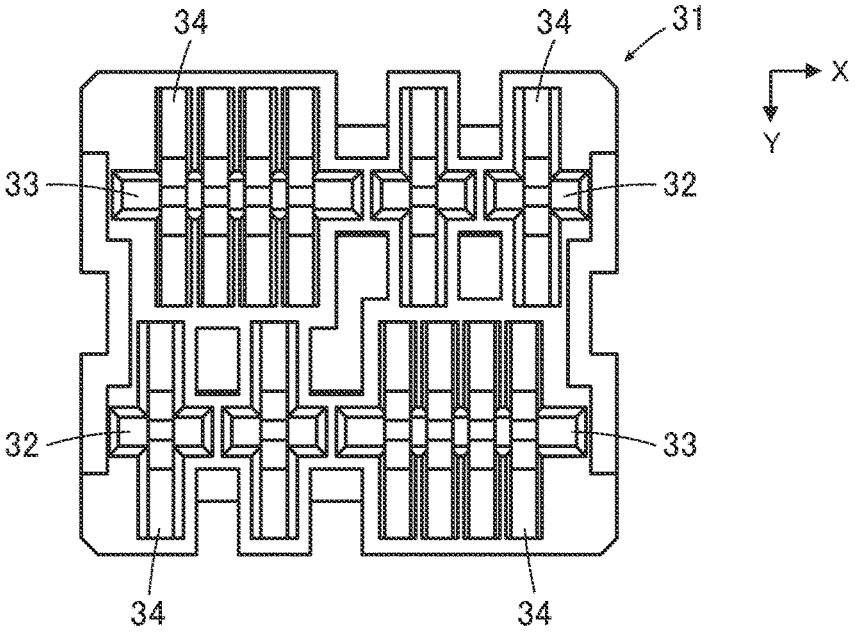
FIG. 4 is a bottom view illustrating an insulator used in the electric connector according to the embodiment.

FIG. 4 illustrates a bottom view of the insulator 31 as viewed from the −Z direction. The insulator 31 is provided with press-fit grooves 32 into which the vertical portions 22B of the signal contacts 22 in the fixing-side contacts 21 are press-fitted and press-fit grooves 33 into which the vertical portions 23B of the power supply contacts 23 in the fixing-side contacts 21 are press-fitted. These press-fit grooves 32 and 33 extend in the X direction and also extend in the Z direction. Also, the press-fit grooves 32 and 33 are each sized such that the vertical portion 22B of the signal contact 22 and the vertical portion 23B of the power supply contact 23 in the fixing-side contact 21 may be press-fitted and fixed into the press-fit grooves 32 and 33.

Also, the insulator 31 is provided with one relay contact insertion groove 34 perpendicular to each press-fit groove 32 and four relay contact insertion grooves 34 perpendicular to each press-fit groove 33. The relay contact insertion groove 34 is sized such that the relay contact 41 inserted therein can swing mainly in the YZ plane.

Figure 5:
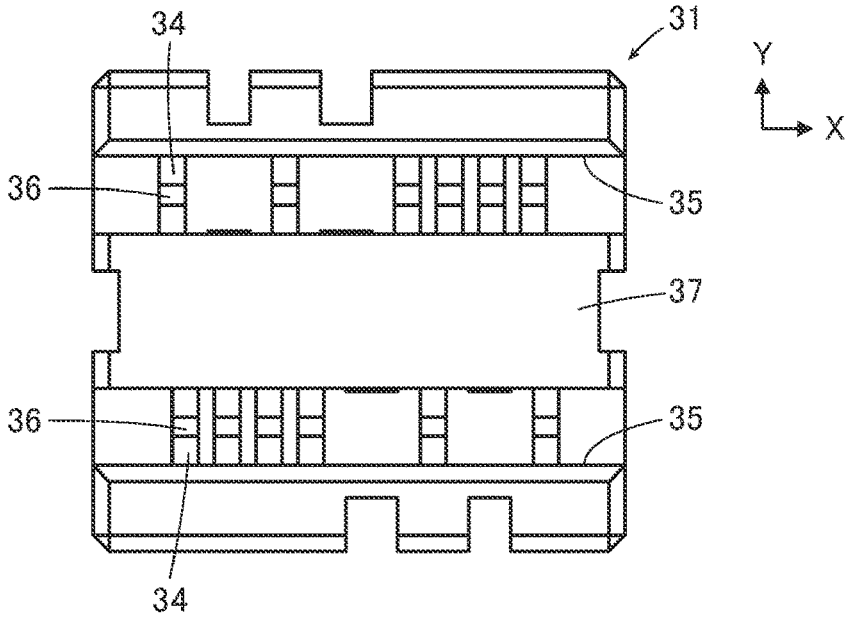
FIG. 5 is a plan view illustrating the insulator used in the electric connector according to the embodiment.

FIG. 5 illustrates a plan view of the insulator 31 as viewed from the +Z direction. On an upper surface of the insulator 31 formed substantially in a cuboid shape, two openings 35 extending in the X direction for receiving the contacts of the counter connector described below are formed. When the insulator 31 is viewed from the +Z direction, a part of each relay contact insertion groove 34 can be seen inside these openings 35. Inside each relay contact insertion groove 34, a beam portion 36 penetrating the relay contact insertion groove 34 in the X direction is formed.

Also, on the upper surface of the insulator 31, a planar suction portion 37 is formed between the two openings 35. The suction portion 37 is used to suck the insulator 31 or the electric connector 11 by means of a not-illustrated suction tool when the electric connector 11 is assembled or mounted.

The relay contacts 41 are inserted into the plurality of relay contact insertion grooves 34 of the insulator 31 from the −Z direction, and in this state, the vertical portions 22B of the signal contacts 22 and the vertical portions 23B of the power supply contacts 23 are press-fitted into the plurality of press-fit grooves 32 and 33 of the insulator 31 from the −Z direction, whereby the electric connector 11 is assembled.

Figure 6:
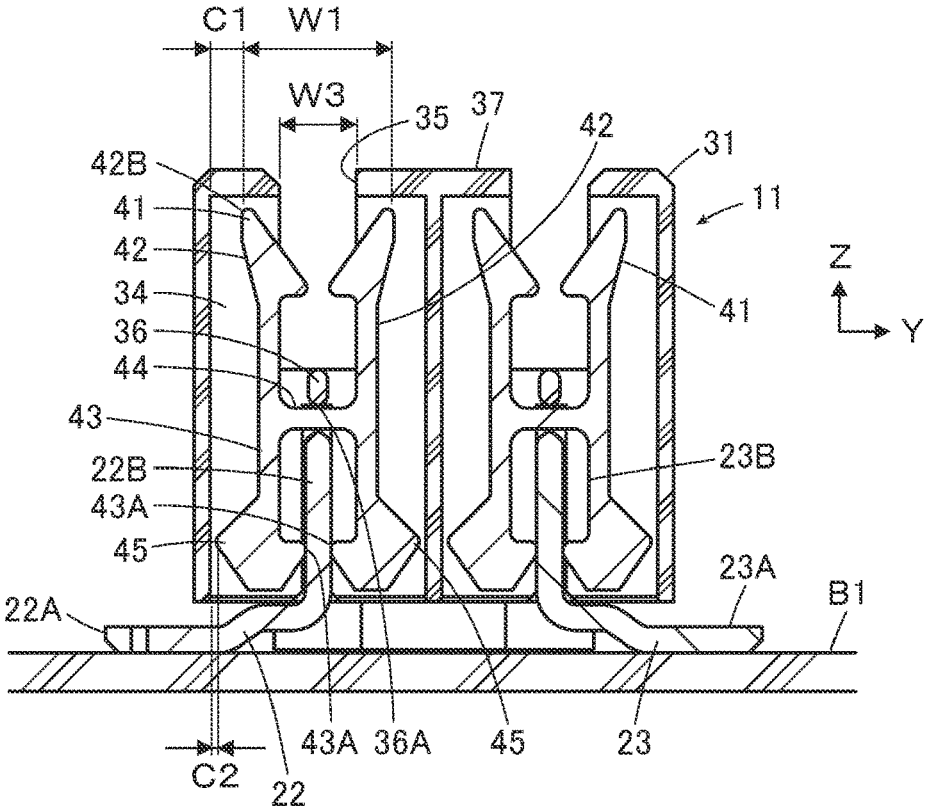
FIG. 6 is a cross-sectional view of the electric connector according to the embodiment.

FIG. 6 illustrates an inside of the electric connector 11 assembled in this manner and mounted on the first board B1.

The relay contacts 41 are housed in the relay contact insertion grooves 34 of the insulator 31, and the connection portion 44 of each relay contact 41 is arranged between a +Z-direction end of the vertical portion 22B of the signal contact 22 and the beam portion 36 of the insulator 31. In the Y direction, the vertical portion 22B of the signal contact 22 is sandwiched between the contact portions 43A of the pair of rear arms 43 of the relay contact 41, and as a result, the relay contact 41 is held to be swingable in a YZ plane with respect to the signal contact 22 and is electrically connected to the signal contact 22.

In particular, since a clearance C1 is secured between each of the pair of front arms 42 of the relay contact 41 and an inside surface of the relay contact insertion groove 34 along a XZ plane, and the vertical portion 22B of the signal contact 22 is sandwiched between the contact portions 43A of the pair of rear arms 43 of the relay contact 41, the relay contact 41 is housed in the relay contact insertion groove 34 to be swingable in a YZ plane, centering on a portion between the contact portions 43A of the pair of rear arms 43 of the relay contact 41.

Meanwhile, the beam portion 36 of the insulator 31 includes a rounded curved surface 36A at a portion thereof opposed to the connection portion 44 of the relay contact 41. For this reason, the relay contact 41 can smoothly swing in the relay contact insertion groove 34 without being caught by the beam portion 36.

Also, to prevent the +Z-direction end 42B of the front arm 42 of the relay contact 41 from projecting into the opening 35 of the insulator 31 as viewed from the +Z direction even when the relay contact 41 significantly swings in the relay contact insertion groove 34 so as to contact the inside surface of the relay contact insertion groove 34 along a XZ plane, an opening width W3 of the opening 35 at +Z-direction end of the insulator 31 is formed to be shorter than the opening width W1 at the +Z-direction ends 42B of the front arms 42 of the relay contact 41 in the Y direction. Therefore, even when the relay contact 41 is significantly swinging when the contact of the counter connector described below is inserted into the opening 35 of the insulator 31, the +Z-direction end 42B of the front arm 42 of the relay contact 41 does not interfere with insertion of the contact of the counter connector, and the contact of the counter connector is guided to the contact portions 42A by the guide surfaces G inclined with respect to the Z direction.

Meanwhile, since the pair of rear arms 43 of the relay contact 41 are separately provided with the projection portions 45 projecting in the Y direction, a clearance C2 formed between each of the pair of rear arms 43 and the inside surface of the relay contact insertion groove 34 along a XZ plane is shorter than the clearance C1 formed between each of the pair of front arms 42 and the inside surface of the relay contact insertion groove 34 along a XZ plane. Accordingly, the electric connector 11 is configured such that, at the time of assembling the electric connector 11, the relay contact 41 can easily be press-fitted into the insulator 31 while the vertical portion 22B of the signal contact 22 is sandwiched between the contact portions 43A of the pair of rear arms 43 without the pair of rear arms 43 of the relay contact 41 inserted into the relay contact insertion groove 34 of the insulator 31 significantly swinging in the Y direction.

Similarly to the case of the vertical portion 22B of the signal contact 22, the relay contact 41 is swingably held at the vertical portion 23B of the power supply contact 23 as well. Although FIG. 6 illustrates only one relay contact 41 held at the vertical portion 23B of the power supply contact 23, four relay contacts 41 are each swingably held at the vertical portion 23B of the power supply contact 23, which enables high power for power supply to be transmitted.

Figure 7:
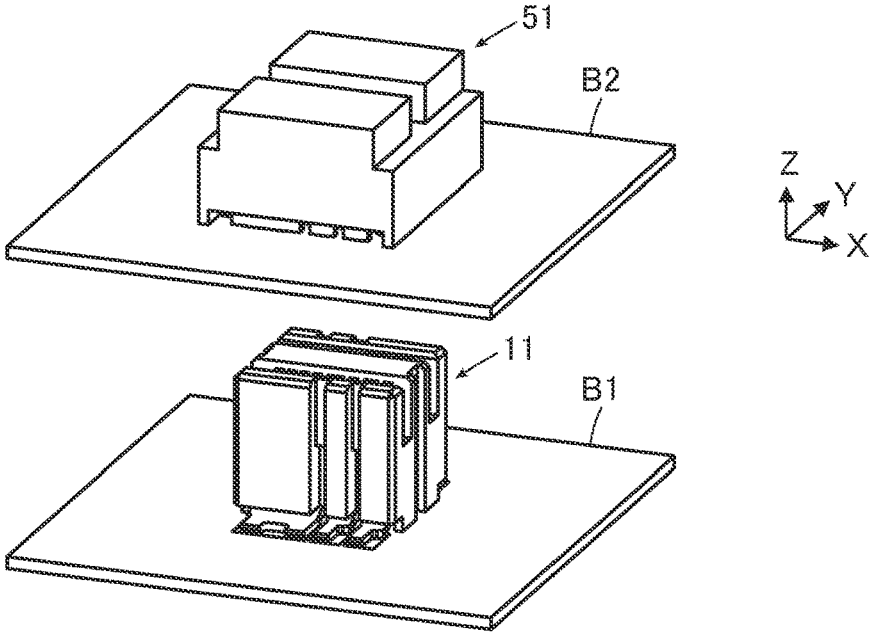
FIG. 7 is a perspective view illustrating a state in which a counter connector is aligned with the electric connector according to the embodiment.

FIG. 7 illustrates a state in which a counter connector 51 is aligned with the electric connector 11 on the +Z-direction side thereof. The counter connector 51 is mounted on a second board B2.

Figure 8:
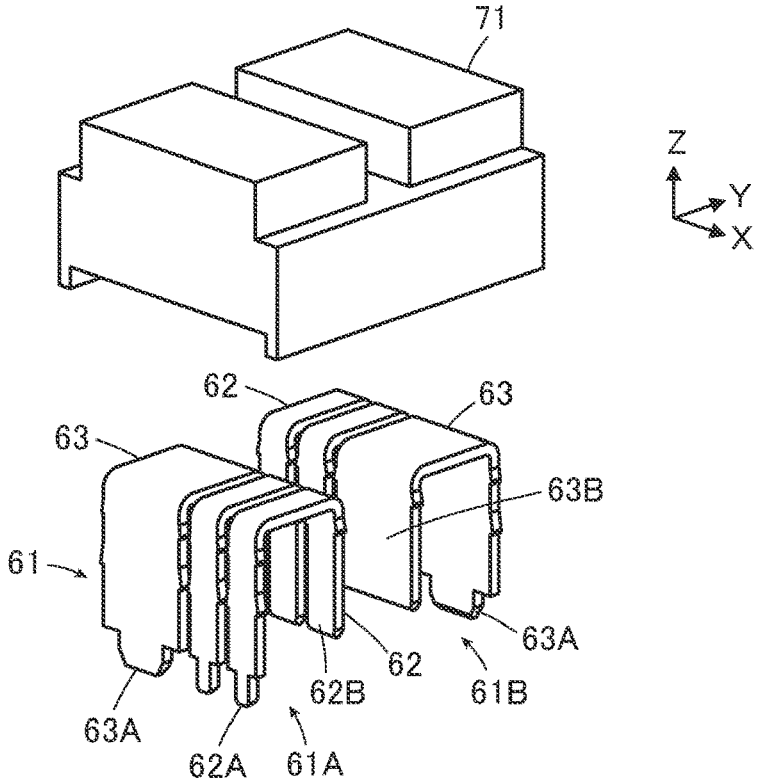
FIG. 8 is an exploded perspective view of the counter connector.

As illustrated in FIG. 8, the counter connector 51 includes a plurality of contacts 61 and an insulator 71 in which the plurality of contacts 61 are to be fixed. The contacts 61 include two contact groups 61A and 61B arranged to be opposed to each other in the Y direction, and each of the contact groups 61A and 61B includes two signal contacts 62 and one power supply contact 63 arranged in the X direction.

Each of the signal contacts 62 includes a mounted portion 62A extending along an XZ plane and mounted on the second board B2 and a plate-shaped vertical portion 62B extending along an XZ plane. Each of the power supply contacts 63 is formed to be wider than the signal contact 62 and, similarly to the signal contact 62, includes a mounted portion 63A extending along an XZ plane and mounted on the second board B2 and a plate-shaped vertical portion 63B extending along an XZ plane. The vertical portion 62B of the signal contact 62 of the contact group 61A is opposed to the vertical portion 63B of the power supply contact 63 of the contact group 61B, and the vertical portion 62B of the signal contact 62 of the contact group 61B is opposed to the vertical portion 63B of the power supply contact 63 of the contact group 61A.

The signal contacts 62 and power supply contacts 63 are each press-fitted into the insulator 71 and held in the insulator 71.

Figure 9:
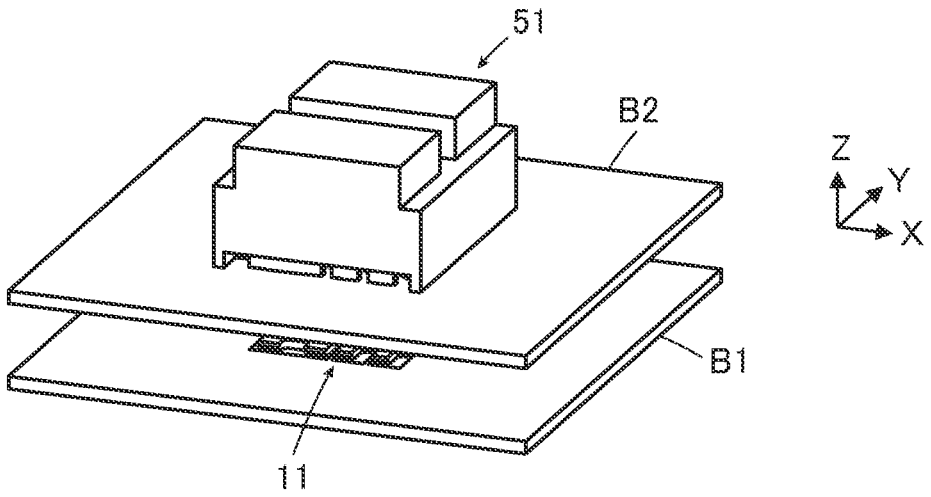
FIG. 9 is a perspective view illustrating the electric connector according to the embodiment and the counter connector in a fitting state.
Figure 10:
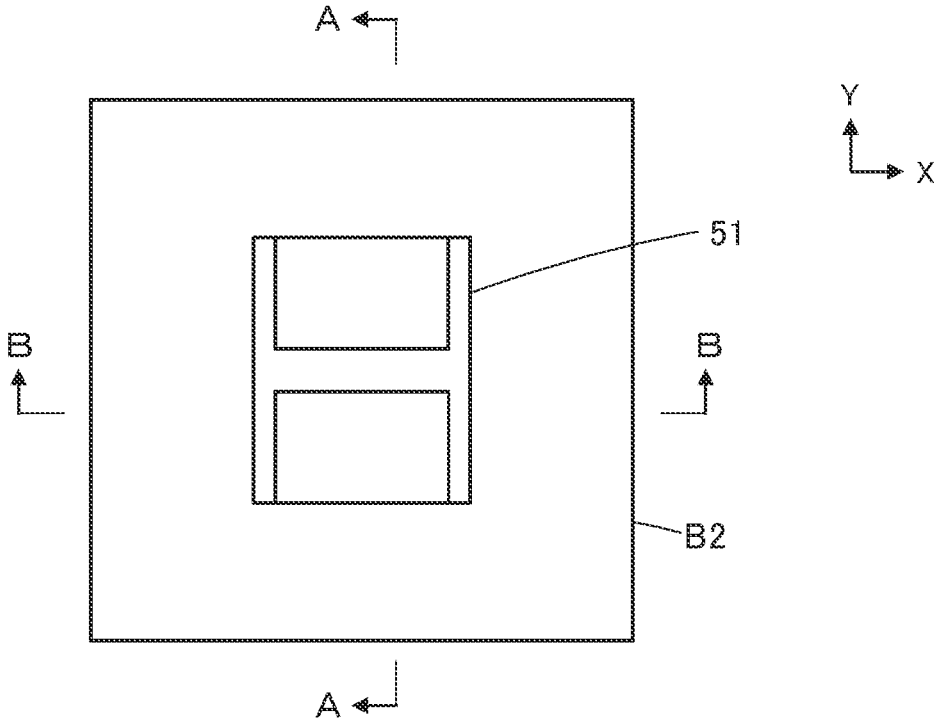
FIG. 10 is a plan view illustrating the electric connector according to the embodiment and the counter connector in the fitting state.

As illustrated in FIG. 7, the counter connector 51 aligned with the electric connector 11 on the +Z-direction side thereof is moved in the −Z direction relatively to the electric connector 11 and is pressed into the electric connector 11 to allow the counter connector 51 to be fitted with the electric connector 11 as illustrated in FIG. 9. FIG. 10 illustrates a plan view of the electric connector 11 and the counter connector 51 at the time of fitting.

Figure 11:
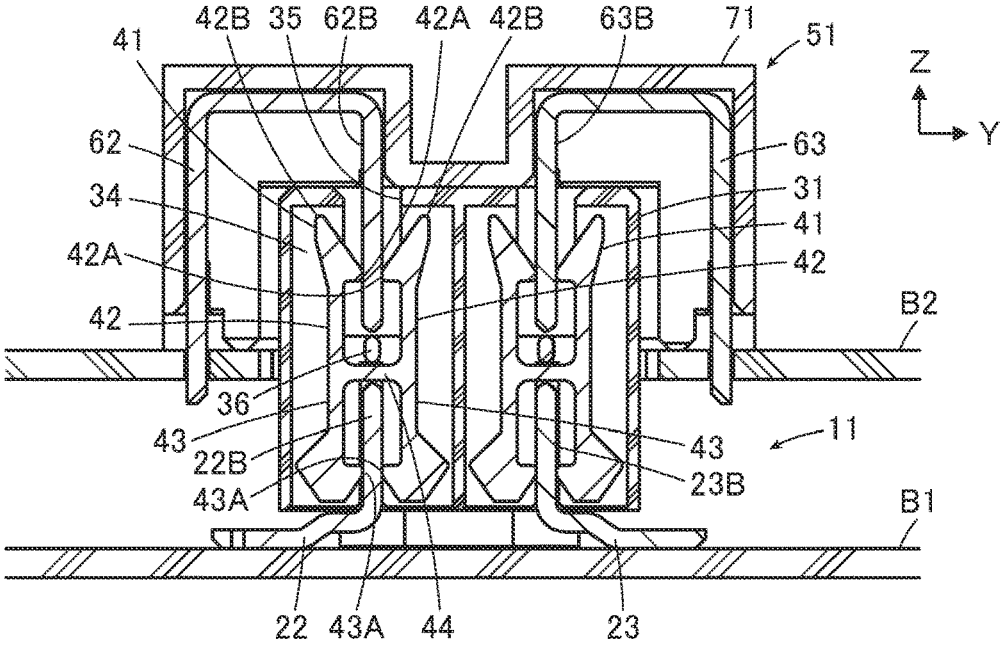
FIG. 11 is a cross-sectional view taken along line A-A in FIG. 10.

When the counter connector 51 is fitted with the electric connector 11 in this manner, as illustrated in FIG. 11, the vertical portion 62B of the signal contact 62 of the counter connector 51 is inserted through the opening 35 of the insulator 31 of the electric connector 11 into the insulator 31 and is sandwiched between the contact portions 42A of the pair of front arms 42 of the relay contact 41. As a result, the signal contact 62 of the counter connector 51 is electrically connected to the signal contact 22 of the electric connector 11 via the relay contact 41. Similarly, the power supply contact 63 of the counter connector 51 is electrically connected to the power supply contact 23 of the electric connector 11 via the relay contact 41.

At this time, each of the relay contacts 41 is swingably housed in the relay contact insertion groove 34 of the insulator 31, and when the signal contact 62 of the counter connector 51 is inserted, the connection portion 44 of the relay contact 41 abuts the +Z-direction end of the vertical portion 22B of the signal contact 22, and thus the relay contact 41 does not project from the relay contact insertion groove 34 in the −Z direction. Similarly, when the power supply contact 63 of the counter connector 51 is inserted, the connection portion 44 of the relay contact 41 abuts the +Z-direction end of the vertical portion 23B of the power supply contact 23, and thus the relay contact 41 does not project from the relay contact insertion groove 34 in the −Z direction.

Also, when a fitting state between the electric connector 11 and the counter connector 51 is released, and the counter connector 51 is pulled out of the electric connector 11, the contact portions 42A of the pair of front arms 42 of the relay contact 41 sandwiching the vertical portion 62B of the signal contact 62 of the counter connector 51 or the vertical portion 63B of the power supply contact 63 in the Y direction are pulled together with the signal contact 62 of the counter connector 51 in the +Z direction. However, the connection portion 44 of the relay contact 41 abuts the beam portion 36 of the insulator 31, and thus the relay contact 41 does not significantly swing in the +Z direction.

Figure 12:
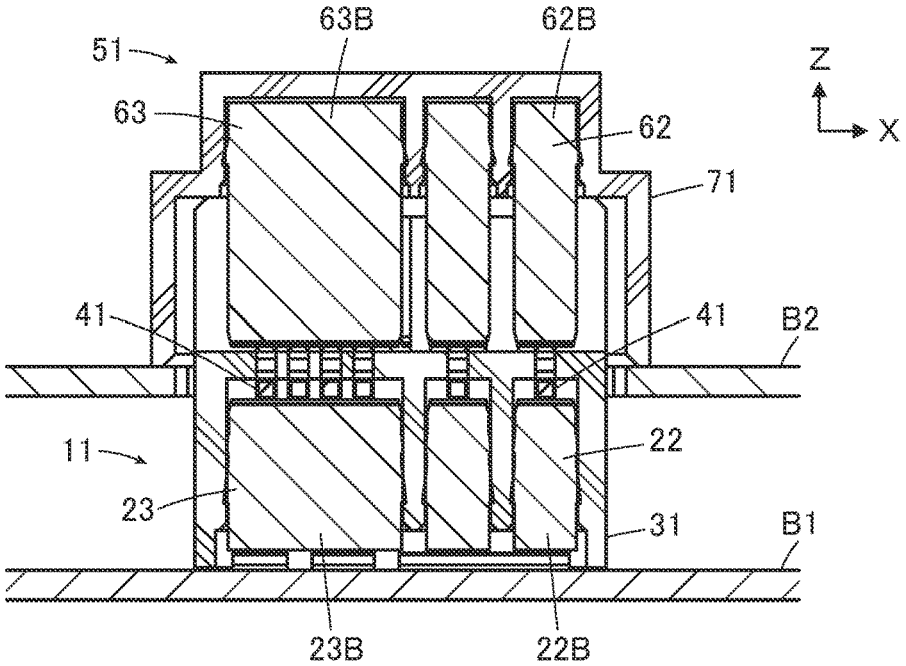
FIG. 12 is a cross-sectional view taken along line B-B in FIG. 10.

Meanwhile, as illustrated in FIG. 12, the signal contacts 62 of the counter connector 51 are each electrically connected to the signal contact 22 of the electric connector 11 via one relay contact 41, and the power supply contact 63 of the counter connector 51 is electrically connected to the power supply contact 23 of the electric connector 11 via four relay contacts 41.

The relay contacts 41 formed in equal shapes are used for the signal contacts 22 and 62 and the power supply contacts 23 and 63. By connecting one relay contact 41 to the signal contacts 22 and 62, and connecting four relay contacts 41 to the power supply contacts 23 and 63, higher power can be transmitted to the power supply contacts 23 and 63.

Figure 13:
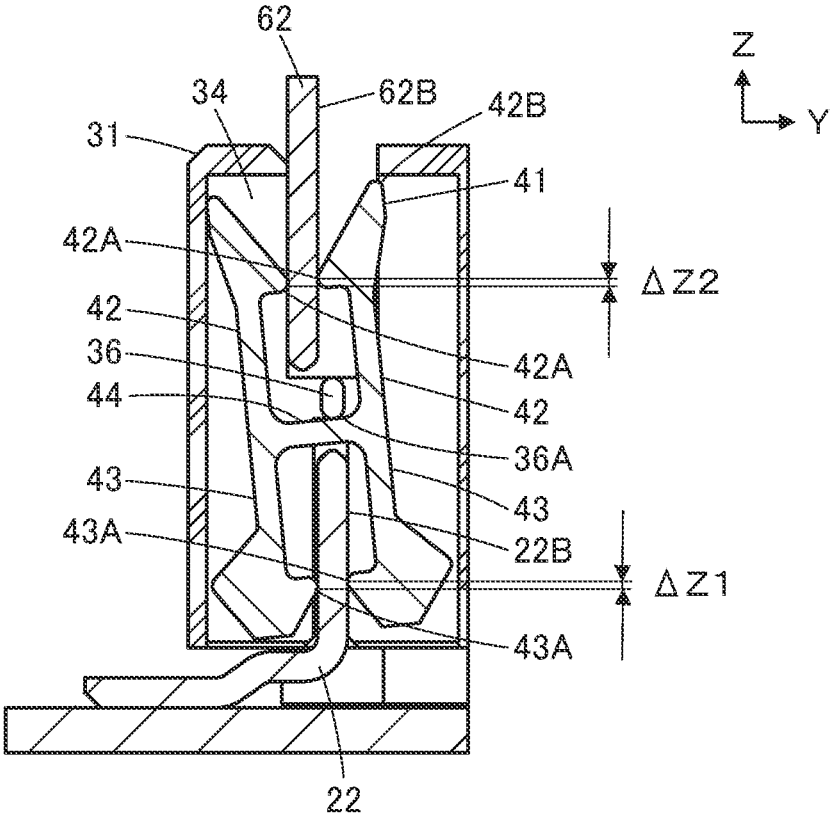
FIG. 13 is a partial cross-sectional view illustrating an inside of the electric connector according to the embodiment when the counter connector is positionally displaced.

The relay contact 41 of the electric connector 11 is held to be swingable in a YZ plane with respect to the signal contact 22 since the vertical portion 22B of the signal contact 22 is sandwiched between the contact portions 43A of the pair of rear arms 43 of the relay contact 41. Accordingly, as illustrated in FIG. 13, when the signal contact 62 of the counter connector 51 is positionally displaced in the Y direction with respect to the signal contact 22 of the electric connector 11, the relay contact 41 is rotated, centering on a portion between the contact portions 43A of the pair of rear arms 43, and is inclined in a YZ plane.

At this time, along with the inclination of the relay contact 41, a displacement amount ΔZ1 is generated in height in the Z direction between locations of the contact portions 43A of the pair of rear arms 43 of the relay contact 41, and a displacement amount ΔZ2 is also generated in height in the Z direction between locations of the contact portions 42A of the pair of front arms 42. However, a state in which the vertical portion 22B of the signal contact 22 is sandwiched between the contact portions 43A of the pair of rear arms 43, and in which the vertical portion 62B of the signal contact 62 of the counter connector 51 is sandwiched between the contact portions 42A of the pair of front arms 42, is maintained, and the signal contact 22 of the electric connector 11 and the signal contact 62 of the counter connector 51 are electrically connected to each other via the relay contact 41.

Meanwhile, the beam portion 36 of the insulator 31 includes the rounded curved surface 36A at a portion thereof opposed to the connection portion 44 of the relay contact 41. Therefore, when the signal contact 62 of the counter connector 51 is positionally displaced in the Y direction with respect to the signal contact 22 of the electric connector 11, the relay contact 41 is smoothly inclined in the relay contact insertion groove 34 without being caught by the beam portion 36.

Similarly, even when the relay contacts 41 are inclined due to positional displacement of the power supply contact 63 of the counter connector 51 with respect to the power supply contact 23 of the electric connector 11, the power supply contact 23 of the electric connector 11 and the power supply contact 63 of the counter connector 51 are electrically connected to each other via the relay contacts 41.

Also, as illustrated in FIG. 12, the vertical portion 62B of the signal contact 62 of the counter connector 51 is longer in width in the X direction than the relay contact 41. For this reason, even when the signal contact 62 of the counter connector 51 is positionally displaced in the X direction with respect to the signal contact 22 of the electric connector 11, a state in which the signal contact 22 of the electric connector 11 and the signal contact 62 of the counter connector 51 are electrically connected to each other via the relay contact 41 is maintained as long as the positional displacement is in a range in which the signal contact 62 of the counter connector 51 contacts the relay contact 41.

As described above, in the electric connector 11 according to the embodiment, the relay contact 41 is held to be swingable in a YZ plane with respect to the signal contact 22 or the power supply contact 23 since the vertical portion 22B of the signal contact 22 or the vertical portion 23B of the power supply contact 23 is sandwiched between the contact portions 43A of the pair of rear arms 43 of the relay contact 41. Therefore, the positional displacement with respect to the counter connector 51 can be absorbed, and the electric connection to the counter connector 51 can be maintained.

Also, the opening width W3 in the Y direction of the opening 35 of the insulator 31 is formed to be shorter than the opening width W1 at the +Z-direction ends 42B of the front arms 42 of the relay contact 41. Hence, even when the relay contact 41 significantly swings in the relay contact insertion groove 34, the +Z-direction ends 42B of the front arm 42 of the relay contact 41 do not collide with the contact of the counter connector. Therefore, even when the plurality of relay contacts 41 are arranged and differ in orientation from one another, the +Z-direction ends 42B of the front arms 42 of any of the relay contacts 41 do not interfere with insertion of the contacts of the counter connector.

Figure 14:
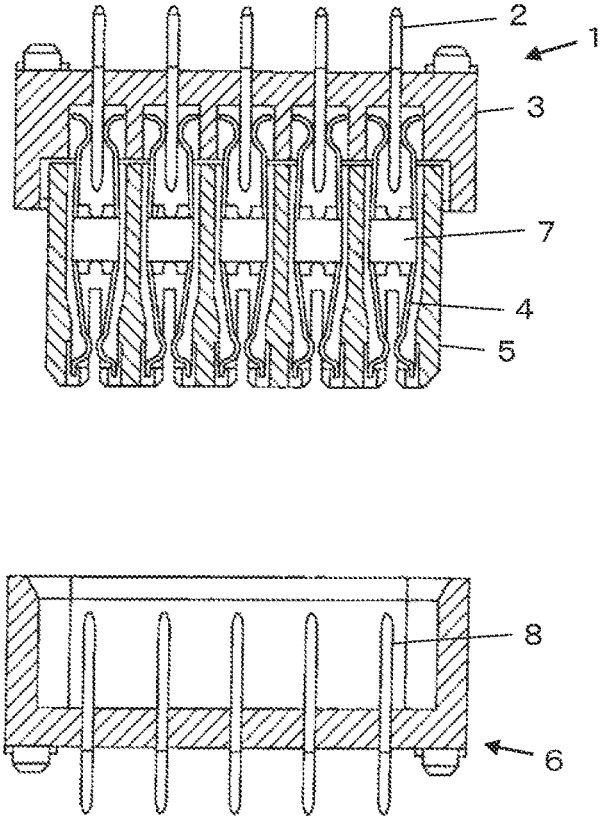
FIG. 14 PRIOR ART
FIG. 14 is a cross-sectional view illustrating a conventional connector and a counter connector.
Figure 15:
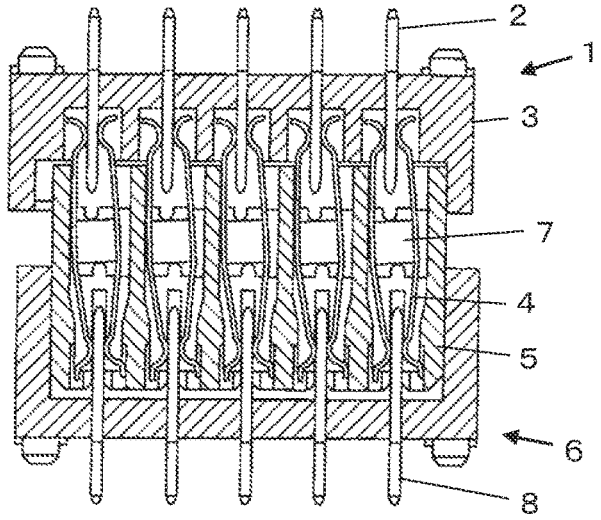
FIG. 15 PRIOR ART
FIG. 15 is a cross-sectional view illustrating the conventional connector and the counter connector in a state of being positionally displaced and fitted.

Also, unlike the conventional connector 1 illustrated in FIGS. 14 and 15, the electric connector 11 does not require two housings including the fixing-side housing 3 and the movable-side housing 5 that can slide with respect to each other. Instead of being held by the insulator 31, the relay contact 41 is swingably held since the vertical portion 22B of the signal contact 22 or the vertical portion 23B of the power supply contact 23 is sandwiched between the contact portions 43A of the pair of rear arms 43. Accordingly, the number of parts and the number of steps for assembling are small, and the manufacturing cost and the size of the connector can be reduced.

Meanwhile, in the above embodiment, the fixing-side contacts 21 include the two contact groups 21A and 21B arranged to be opposed to each other. However, the present invention is not limited to this, the fixing-side contacts 21 may include only one contact group, and the number of contacts in each contact group is not limited. Also, although each of the contact groups 21A and 21B includes two signal contacts 22 and one power supply contact 23, each of the contact groups 21A and 21B may include only the signal contact(s) 22 or only the power supply contact(s) 23.

Further, in the above embodiment, the pair of front arms 42 as well as the pair of rear arms 43 of the relay contact 41 are opposed to each other in the Y direction that perpendicularly intersects with the vertical portion 22B of the signal contact 22 and the vertical portion 23B of the power supply contact 23. However, the perpendicular intersection is not essential, and the pair of front arms 42 as well as the pair of rear arms 43 are only required to be opposed to each other in a direction simply intersecting with the vertical portion 22B of the signal contact 22 and the vertical portion 23B of the power supply contact 23.

Still further, in the above embodiment, although the relay contact 41 is made of a flat metal plate punched in an H shape, the present invention is not limited to this, and a relay contact formed by, for example, bending a metal plate can also be used.

What is claimed is:

1. An electric connector to be fitted with a counter connector along a fitting direction and electrically connected to the counter connector, the electric connector comprising:

a fixing-side contact including a vertical portion of plate shape extending in the fitting direction;

a relay contact including a pair of front arms extending forward in the fitting direction and opposed to each other in an intersection direction intersecting with the vertical portion of the fixing-side contact and a pair of rear arms extending rearward in the fitting direction and opposed to each other in the intersection direction, the vertical portion of the fixing-side contact being sandwiched between the pair of rear arms so that the relay contact is held to be swingable with respect to the fixing-side contact and is electrically connected to the fixing-side contact; and an insulator including a relay contact insertion groove that has an opening opened forward in the fitting direction, wherein the fixing-side contact is fixed to the insulator, wherein the relay contact is housed in the relay contact insertion groove of the insulator, wherein, in the intersection direction, an opening width of the opening of the relay contact insertion groove of the insulator is shorter than an opening width at ends of the pair of front arms located on a forward side in the fitting direction, and, even when the relay contact swings, the ends of the pair of front arms of the relay contact do not project into the opening of the relay contact insertion groove as viewed from the forward side in the fitting direction, and wherein, when fitting with the counter connector, a contact of the counter connector is sandwiched between the pair of front arms of the relay contact, whereby the electric connector is electrically connected to the counter connector.

2. The electric connector according to claim 1, wherein the pair of front arms of the relay contact include a pair of contact portions to sandwich and contact the contact of the counter connector, and wherein an opening width at the pair of contact portions of the relay contact is shorter than the opening width at the ends of the pair of front arms, and an inclined guide surface is formed from the end to the contact portion of each of the pair of front arms.

3. The electric connector according to claim 1, wherein the relay contact is made of a flat metal plate punched in an H shape.

4. The electric connector according to claim 1, wherein a clearance between each of the pair of rear arms and an inside surface of the relay contact insertion groove is shorter than a clearance between each of the pair of front arms and an inside surface of the relay contact insertion groove.

5. The electric connector according to claim 1, wherein the opening width at the pair of front arms of the relay contact is longer than an opening width at the pair of rear arms.

6. The electric connector according to claim 1, wherein the relay contact includes a connection portion arranged between the pair of front arms and the pair of rear arms and extending in the intersection direction, and wherein the insulator includes a beam portion arranged inside the relay contact insertion groove and opposed to the connection portion of the relay contact.

7. The electric connector according to claim 6, wherein the beam portion includes a rounded curved surface at a portion of the beam portion opposed to the connection portion of the relay contact.

8. The electric connector according to claim 1, comprising a plurality of the fixing-side contacts, and wherein at least one relay contact is arranged to correspond to each of the fixing-side contacts.

9. The electric connector according to claim 8, wherein a plurality of the relay contacts are swingably held at and electrically connected to at least one of the plurality of the fixing-side contacts.

* * * * *